United States Patent [19]

Ballard et al.

[11] Patent Number: 4,789,849

[45] Date of Patent: Dec. 6, 1988

[54] AMORPHOUS METAL TRANSFORMER CORE AND COIL ASSEMBLY

[75] Inventors: Donald E. Ballard, Conover; Willi Klappert, Hickery, both of N.C.

[73] Assignee: General Electric Company, King of Prussia, Pa.

[21] Appl. No.: 159,371

[22] Filed: Jan. 19, 1988

Related U.S. Application Data

[62] Division of Ser. No. 804,412, Dec. 4, 1985, Pat. No. 4,734,975.

[51] Int. Cl.[4] ..... H01F 27/24

[52] U.S. Cl. ..... 336/210; 336/213; 336/217; 336/219

[58] Field of Search ..... 336/211, 212, 213, 216, 336/217, 233, 234, 219, 210; 29/605, 606, 609

[56] References Cited

U.S. PATENT DOCUMENTS

| | | | |
|---|---|---|---|
| 2,937,352 | 5/1960 | Vienneau et al. | 336/216 |
| 3,074,039 | 1/1963 | Ford | 336/219 X |
| 3,210,709 | 10/1965 | Ellis et al. | 336/217 |
| 3,339,163 | 8/1967 | Wentz et al. | 336/211 |
| 4,364,020 | 12/1982 | Lin et al. | 336/212 |
| 4,506,248 | 3/1985 | Lin | 336/233 |
| 4,520,335 | 5/1985 | Rauch et al. | 336/212 |

*Primary Examiner*—Thomas J. Kozma

*Attorney, Agent, or Firm*—Henry J. Policinski; William Freedman; Robert A. Cahill

[57] ABSTRACT

This transformer comprises preformed coil structure and a wound core of closed-loop configuration extending about a window and having joints in a localized region thereof that allow the core to be opened at the joints to permit insertion into the window of the preformed coil structure. The core comprises superposed laminations of thin amorphous ferromagnetic strip material which extend around the core from the localized joint region. The laminations include predetermined portions adjacent the joints that are displaced to provide a wide opening into the core window for insertion of the coil structure. A coating of adhesive bonding agent applied before said displacement is present on the lateral edges of the laminations in regions of the core not including said predetermined portions, thereby holding the laminations in correct assembled relationship when the core is opened, yet without interfering with displacement of said predetermined portions.

13 Claims, 3 Drawing Sheets

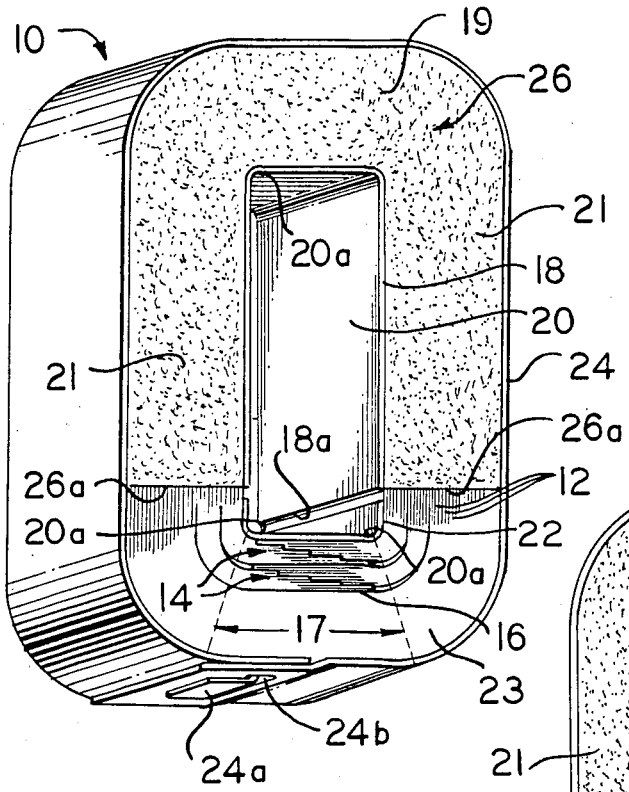
FIG. 2
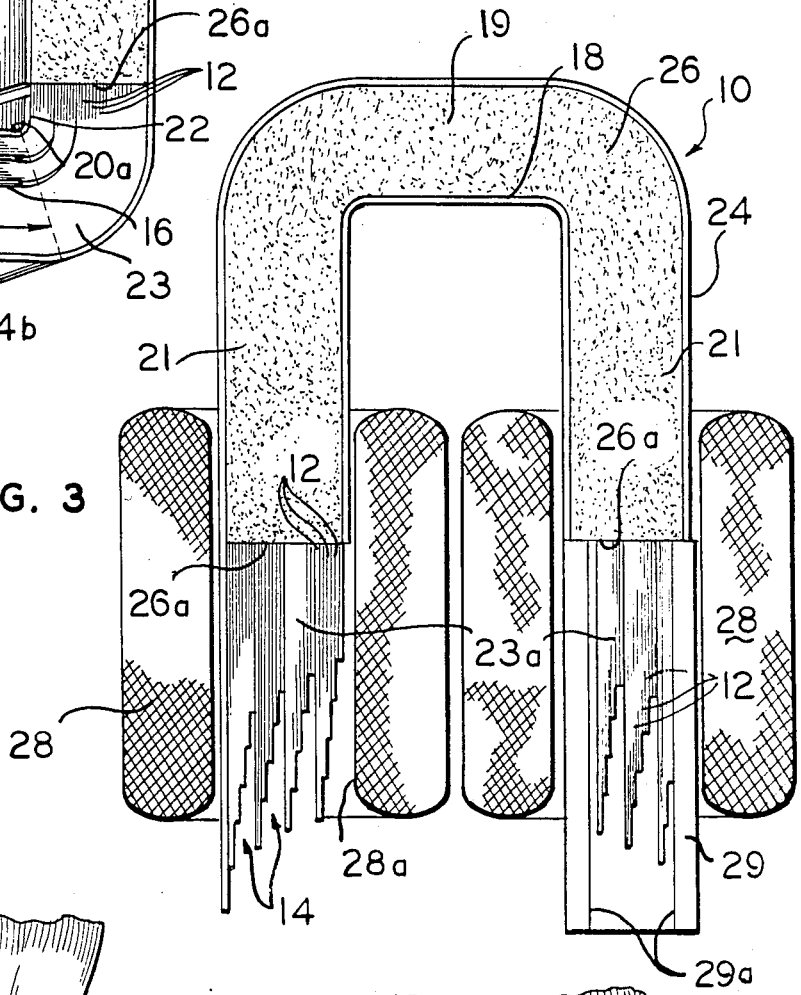
FIG. 3
FIG. 4
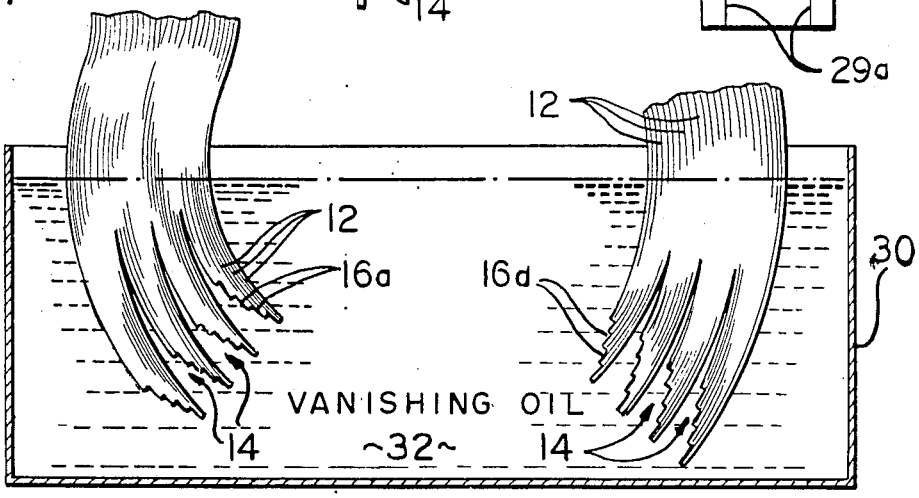

FIG. 5
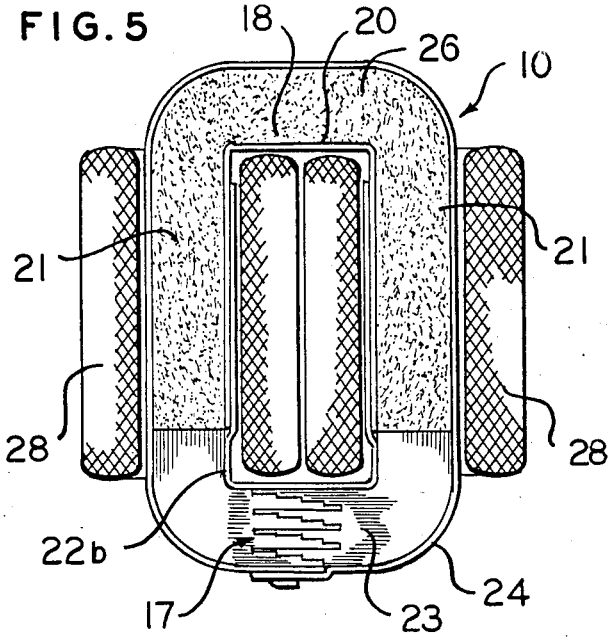
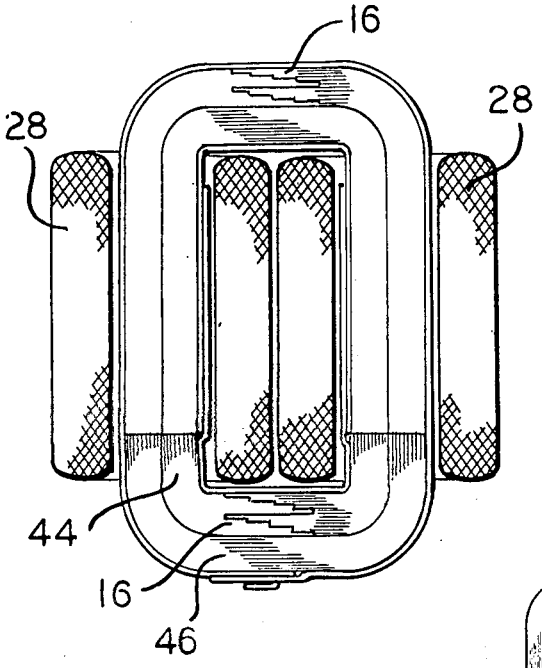
FIG. 7
FIG. 6
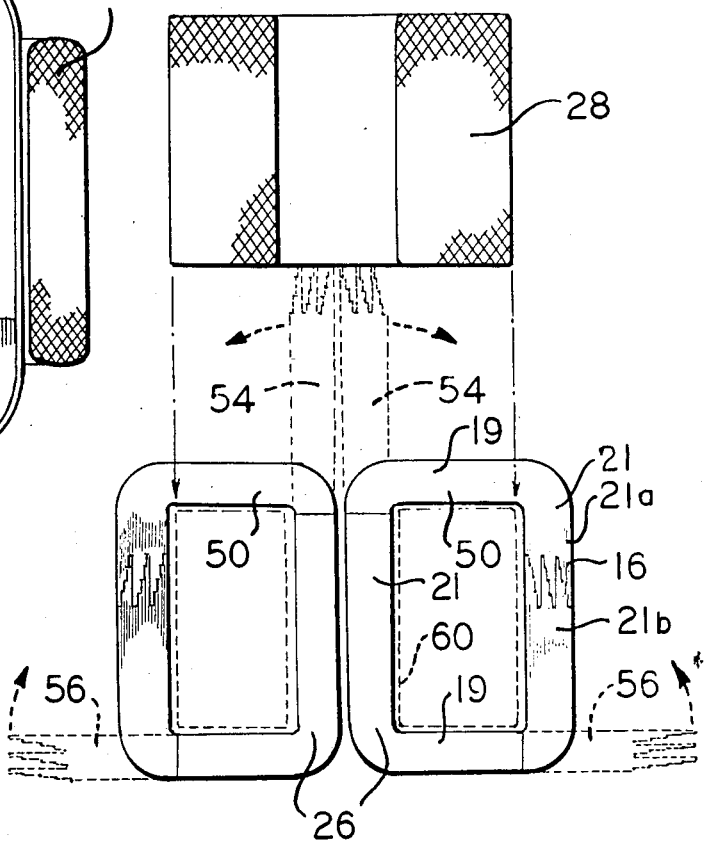

AMORPHOUS METAL TRANSFORMER CORE AND COIL ASSEMBLY

This is a division, of application Ser. No. 804,412, filed Dec. 4, 1985.

BACKGROUND OF THE INVENTION

The invention herein disclosed is based upon work sponsored in part by the Electric Power Research Institute, Palo Alto, Calif.

The present invention relates to electrical transformers and particularly to transformers having amorphous metal cores.

Traditionally, electrical transformer cores have been formed of high grain oriented silicon steel laminations. Over the years, significant improvements have been made in such electrical steels to permit reductions in transformer core sizes, manufacturing costs and the losses introduced into an electrical distribution system by the transformer core. As the cost of electrical energy continues to rise, reductions in core loss have become an increasingly important design consideration in all sizes of electrical transformers. For this reason, amorphous ferromagnetic materials are being used as transformer core materials to achieve a dramatic decrease in transformer core operating losses.

Amorphous metals are principally characterized by a virtual absence of a periodic repeating structure on the atomic level, i.e., the crystal lattice, which is a hallmark of their crystalline metallic counterparts. The non-crystalline amorphous structure is produced by rapidly cooling a molten alloy of appropriate composition such as those described by Chen et al., in U.S. Pat. No. 3,856,513, herein incorporated by reference. Due to the rapid cooling rates, the alloy does not form in the crystalline state, but assumes a metastable non-crystalline structure representative of the liquid phase from which it was formed. Due to the absence of crystalline atomic structure amorphous alloys are frequently referred to as "glassy" alloys.

Due to the nature of the manufacturing process, an amorphous ferromagnetic strip suitable for winding a distribution transformer core, for example, is extremely thin, nominally one mil versus 7–12 mils for grain oriented silicon steel. Moreover, such amorphous ferromagnetic strips are quite brittle and thus easily fractured. Consequently, the fabrication of wound amorphous metal cores presents unique problems of handling the very thin strips throughout the various manufacturing steps of winding the core, cutting and rearranging the core laminations into a desired joint pattern, shaping and annealing the core, and finally lacing the core through the window of a preformed transformer coil, which involves first opening and then reclosing the joints in the core. Of particular importance is the lacing step which must be effected with great care to avoid permanently deforming the core from its annealed configuration after the core has been laced into the coil window. That is, if the core is not exactly returned to its annealed shape, stresses are introduced during the lacing procedure. Consequently, if there are significant stresses remaining after lacing, the potential low core loss characteristic offered by the amorphous metal core material is not achieved. Since amorphous metal laminations are quite weak and have little resiliency, they are readily disoriented during the lacing step, resulting in permanent core deformation if not corrected. In addition to this concern, there is also the obvious concern that the lacing step be carried out with sufficient care such as to avoid fracturing the brittle amphorous metal laminations.

It is accordingly an object of the present invention to provide an improved wound amorphous metal transformer core and coil assembly.

An additional object is to provide a wound amorphous metal core and coil assembly of the above character wherein the potential low core loss characteristic thereof is preserved during the transformer manufacturing process.

A further object is to provide a wound transformer core of the above character, wherein the amorphous metal laminations thereof are restrained against disorientation during the lacing step of assembling the core with a winding coil.

Another object is to provide a wound transformer core of the above-noted character wherein the amorphous metal laminations thereof are protected against breakage through the transformer manufacturing process.

A still further object is to provide a wound amorphous metal transformer core which is efficient in design, economical to manufacture and reliable over a long service life.

Another object of the invention is to provide an improved method for manufacturing a transformer core and coil assembly of the above-noted character.

Other objects of the invention will in part be obvious and in part appear hereinafter.

SUMMARY OF THE INVENTION

In accordance with the present invention, there is provided a wound transformer core of closed-loop configuration extending about a window and joints in said core in a localized region thereof that allow the core to be opened to permit insertion into the window of preformed coil structure. The core comprises superposed laminations of thin amorphous ferromagnetic strips that extend continuously around the core from said localized joint region. Each joint comprises two joint halves, each of which comprises a plurality of said amorphous metal laminations. The amorphous metal laminations are supported on at least one innermost layer of a thickness considerably greater than that of an amorphous metal lamination. This foundation layer may be formed of conventional silicon electrical steel and serves to protect the amorphous metal laminations against fracture particularly during core shaping. Moreover, the amorphous metal laminations are nested in an outermost locking turn also of silicon electrical steel which serves to positionally control and protect these laminations during annealing and after the core has been laced into the coil structure to achieve a core and coil assembly. To restrain the amorphous metal laminations against disorientation during this lacing step, the laminations are edge bonded together using a suitable bonding agent.

The invention accordingly comprises the features of construction, combination of elements and arrangement of parts, together with a method for manufacturing same, which will be exemplified in the construction and method hereinafter set forth, and the scope of the invention will be indicated in the claims.

BRIEF DESCRIPTION OF THE DRAWINGS

For a better understanding of the nature and objects of the invention, reference should be had to the following detailed description taken in conjunction with the accompanying drawings, in which:

FIG. 2 is a perspective view of the core of FIG. 1A shown in a shaped rectangular configuration;

FIG. 3 is a perspective view of the core of FIG. 2 shown opened up preparatory to being laced about a pair of transformer coils;

FIG. 4 is a side view, partially broken away, showing the opened ends of the core of FIG. 3 being immersed in oil to facilitate the core lacing procedure;

FIG. 5 is a side elevational view of the core of FIG. 3 shown laced about a pair of transformer coils;

FIG. 6 is an assembly view illustrating application of the present invention to a shell type transformer core and coil assembly; and FIG. 7 is a side elevational view of a transformer core and coil assembly wherein the core is formed as a pair of nested core units.

Like reference numerals refer to corresponding parts throughout the several views of the drawings.

DETAILED DESCRIPTION

Figure 1:
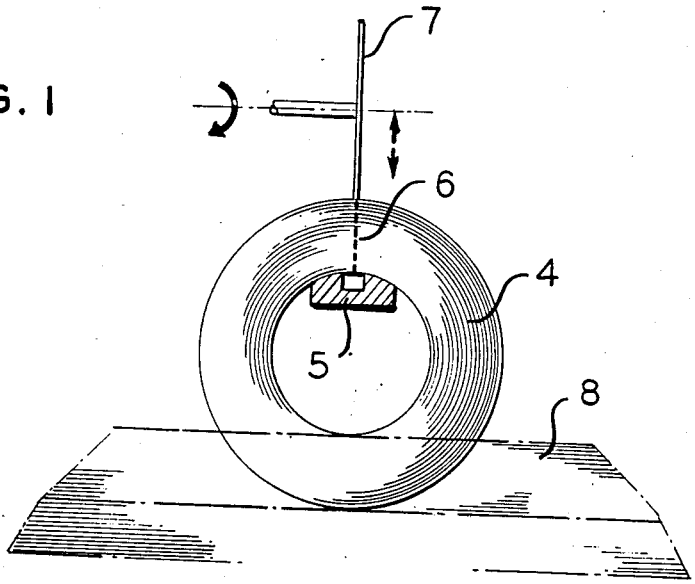
FIG. 1 is a side elevational view showing the cutting of an annular form to provide a stack of laminations for use in the core of this invention.

Referring to FIG. 1, there is shown an annular form 4 from which the transformer core of this invention is made. This annular form 4 is produced by winding a strip of amorphous ferromagnetic material about a mandrel (now shown). A suitable amorphous strip material is one marketed by Allied Corporation of Morristown, N.J. as its METGLAS Type 2605-SC material. After being wound, the annular form 4 is placed on a stationary support 5 extending through its window and is cut along a single radial line 6 by a thin rotating abrasive wheel 7. Thereafter, the resulting laminations are allowed to fall into a stack of single-turn laminations, shown in dotted line form at 8.

Beginning from the top of the stack 8, the laminations are then fed in sub-stacks, each containing between 10 and 20 aligned laminations, into a suitable belt nester (not shown). The belt nester can be of the general type illustrated at 50 in U.S. Pat. No. 4,413,406—Ballard et al or at 60–66 in U.S. Pat. No. 4,467,632—Klappert, with suitable modifications to accommodate the fact that the laminations are of amorphous metal. Since the belt nester is not a part of the present invention, it has not been shown in the drawings or described herein in detail. The belt nester acts to form a new annulus, shown at 10 in FIG. 1A, that has what is commonly referred to as distributed lap joints in its region 17. In one form of the invention, these distributed lap joints are formed by causing the opposite ends of each sub-stack of laminations fed into the belt nester to overlap each other by a small amount to form a lap joint 16 and by causing successive, or radially-adjacent, lap joints 16 to be angularly displaced from each other.

Each lap joint may be thought of as a step and a series of lap joints as a series of steps. After a series of lap joints covering a predetermined arc has been formed, the belt nester starts the next step at the same angular position as the first step and forms another series of steps over generally the same angle as the first series, repeating this sequence over and over until all of the laminations have been incorporated into the new annulus 10. It will be noted that these lap joints, or steps, are all located in a localized joint region of core 10, as generally indicated at 17.

Figure 1A:
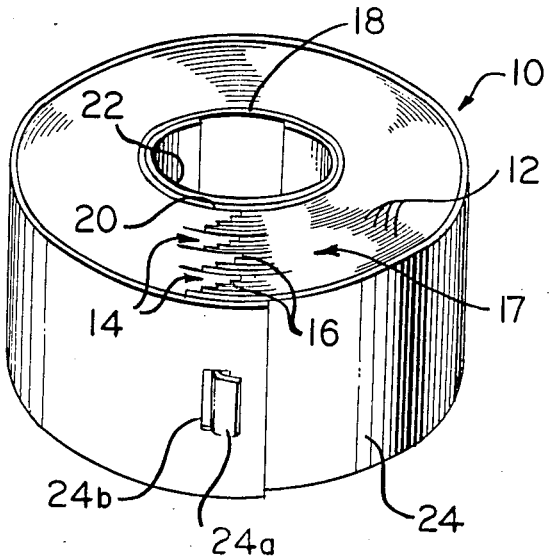
FIG. 1A is a perspective view of a wound amorphous metal transformer core constructed in accordance with the present invention and shown in its intermediary annular configuration prior to shaping.
Figure 1B:
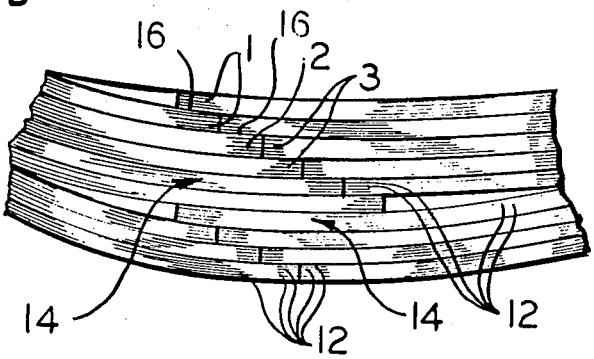
FIG. 1B is an enlarged view of some of the distributed gap jonts formed in the core of FIG. 1A.

An enlarged view of such a series 14 of joints is shown in FIG. 1B. The sub-stacks of each series of steps are respectively designated 1, 2, and 3. The ends of each sub-stack, e.g., 1, can be seen overlapping, and the successive joints, e.g., 1—1, 2—2, 3—3, etc., can be seen as angularly offset, or staggered. Each end of a sub-stack located within a joint 16 is referred to hereinafter as a joint half, and is seen to include a plurality of, for example 10 to 20, thin amorphous metal laminations 12.

Each lamination of the amorphous metal is very thin, nominally only about one mil in thickness, as compared to the usual 7 to 12 mil thickness of typical silicon steel laminations for distribution transformer area. Accordingly, the above-referred to sub-stacks have a thickness equivalent to only one or two of such silicon steel laminations. Handling the laminations in sub-stacks, instead of individually, substantially contributes to manufacturing economy. If desired, this new annulus 10 can be formed by a hand nesting operation utilizing the above-described sub-stacks.

Still referring to FIG. 1A, after the core laminations 12 have been properly nested, a first foundation strip or partial turn 18 is flexed into a semi-circle and fitted into the cylindrical window 20 of core 10. A second foundation strip or partial turn 22 is similarly fitted into window 20 in lapped relation with strip 18. These foundation strips, which may consist of core steel although their magnetic properties are not a necessary feature of the present invention, are of sufficient thickness, e.g. ten mils, and resiliency to provide underlying mechanical support for the core laminations 12 which have little strength to resist collapse of the core. Since these amorphous metal laminations are also quite brittle, these foundation partial turns further serve as protection against chipping and fracturing during the succeeding manufacturing steps and while in service, as will be pointed out below. To provide overlying support for the core laminations 12, an outer locking turn 24, which again may be a strip of ten mil core steel, is provided to contain the annular shape of nested core 10 seen in FIG. 1A. For a more detailed description of such an outer locking turn, reference may be had to commonly assigned U.S. Pat. No. 4,024,486; the patentee thereof being one of the applicants herein. For purposes of the present description, it is believed sufficient to indicate that the underlapped end of the locking turn is formed with a tab **24*a* which is brought out through a locking slot 24*b*** in the overlapped end thereof and bent back to secure the locking turn in embracing relation about the nested core.

After the annular form 10 of FIG. 1A has been constructed as above described, it is placed on two suitable forming elements (not shown) that extend through its window 20. These forming elements are then forced apart to shape the form 10 into the rectangular configuration shown in FIG. 2 Prior to this shaping step, foundation turn 22 of FIG. 1 is replaced with a non-lapping shorter one 22a. These thicker foundation partial turns 18 and 22a are seen to be transformed during the shaping step to the U-shaped configurations of FIG. 2. An important function of these foundation turns is to impart a sufficiently large bend radius at the right angle corners 20a of the now rectangular core window 20 about which the relatively brittle amorphous metal laminations 12 must conform, thus significantly reducing the possibility of fracture. Also these foundation partial turns serve as buffer layers effective in preventing damage particularly to the innermost core lamination turn as the core is engaged by forming elements during the core shaping step. The outer locking turn 24, which remains in embracing relation with core 10 during the shaping procedure, also serves as a buffer layer for protecting the outermost core laminations.

After the core has been shaped into the rectangular form of FIG. 2, suitable annealing plates (not shown) are attached to the core adjacent its outer surfaces, following which the core is annealed in a magnetic field in a suitable annealing oven. The annealing acts in a well-known manner to relieve stresses in the amorphous metal laminations, including those imparted during the cutting, nesting, and shaping or forming steps. When annealing has been completed, the annealing plates, referred to above, are removed. During annealing the core is heated to a temperature sufficient to relieve stresses in the amorphous metal laminations, e.g., about 360° C., but not sufficient to anneal the outer locking turn 24 or the partial turns 18 and 22a of the foundation layer, all of which are of a conventional core steel or the like.

Still referring to FIG. 2, as an important feature of the present invention, after core 10 has been annealed, a suitable bonding agent is applied as a layer 26 to the exposed lateral edges of the amorphous metal laminations 12 on both sides of the core. This bonding agent is applied in liquid form, preferably by brushing, following which it dries and forms a resilient coating that bonds together the edges of the laminations. This edge bonding layer is seen to stop along lines 26a which are just short of or at the most flush with the free ends 18a of foundation partial turn 18. Thus, layer 26 secures the laminations 12 together as a unit along the entire length of the illustrated upper side, which may be considered the top yoke 19, and along a substantial portion of the length of the interconnecting legs 21, stopping just short of their corner junctions with the lower yoke 23 containing joint region 17. Thus the amorphous metal laminations 12 are effectively restrained from disorientation relative to each other, while leaving the segments of the laminations in the lower yoke 23 leading to and included in joint region 17 free to open up and accommodate the core lacing procedure described below in conjunction with FIG. 3. Note that foundation partial turn 22a is beyond the edge bonding layer boundary lines 26a, and thus is free to be removed when the core is to be laced about a transformer coil. However, foundation partial turn 18 and locking turn 24 along a substantial portion of their length are edge bonded to the laminations 12. Care should be taken during the application of the bonding agent to avoid penetration between the laminations as this would adversely affect core loss. Suitable edge bonding agents have been found to be SCOTCH-GRIP 826 or SCOTCH-CLAD EC 776, both available from the 3M Company.

After the above-described edge-bonding has been effected, the outer locking turn 24 is unlocked by straightening tab 24a and releasing it from locking slot 24b . With the upper yoke 19 supported with legs 21 extending downwardly therefrom, the non-edge bonded portions of the unlocked outer turn spring into the positions shown in FIG. 3. Also, the two halves 23a of the lower yoke, no longer being restrained by the outer locking turn, fall into their downwardly hanging positions of FIG. 3, separating from each other at the joint region 17 included in the lower yoke. It is seen that edge bonding layer 26 readily accommodates the core being opened up while restraining relative movements of laminations 12 over a substantial portion of their circumferential lengths.

To facilitate the core-lacing operation, the two halves 23a of the lower yoke that extend between the localized joint region 17 and the two corner regions at the ends of the lower yoke are oriented to be substantially aligned with the core legs 21 to which they are attached. As a result, the core is then of an essentially U-shaped configuration with essentially straight legs comprising the original legs 21 and the then-aligned yoke halves 23a. The extended legs of this U-shaped structure can easily be slid through the openings 28a of two transformer coil structures 28 that are respectively adapted to encircle the original legs 21 with only slight clearance. To expedite this procedure and protect the laminations 12, a snugly-fitting splint or chute 29 of sheet metal can be provided around each extended leg (shown only on the right extended leg for convenience) to hold it in its essentially straight-line configuration when it is being inserted into the coil structures 28. Each splint is generally C-shaped in cross section, having three flat sides, with the fourth side open between narrow, right angle-turned corner flanges 29a. The splints are assembled by slightly spreading their open side to facilitate entry of an extended leg thereinto. Preferably, splints 29 are slightly tapered from top to bottom to better guide the extended legs into and through coil openings 28a. After such insertion, the sheet metal splints are slid off their extended legs so as to then permit the groups of laminations in each yoke half 23a to be moved into their original closed-joint positions at right angles to the original legs 21, all as part of the lacing operation. It will be apparent that the corners 20a of the core are substantially flexed during the opening and closing of the core as part of the lacing operation.

It has been discovered that the core lacing procedure is dramatically enhanced, in terms of both facilitating its performance and of avoiding damage to the thin, extremely brittle amorphous metal laminations 12, if the halves 16a of all of the step-lapped joints 16 are dipped in a bath 30 of light weight oil 32, such as so-called "vanishing" oil, as illustrated in FIG. 4. An oil of this type is desirable for its property of leaving very little residue upon evaporation. one such vanishing oil found to be applicable to the invention is 4B oil available from G. Witfield Richards Company of Philadelphia, Pa. The oil 32 is drawn into the interfaces between laminations 12 included in each series 14 of joint halves 16a by capillary action. It is found that the oil is then effective both to draw the laminations into intimate interfacial relation and to adhere the laminations together by surface tension. Consequently, each joint half 16a of from ten to twenty amorphous metal laminations and in most instances each series 14 of joint halves can be handled as a unit pursuant to remaking the step-lapped joints 16 incident to lacing core 10 about transformer coils 28 (FIG. 3). It is readily appreciated that remaking the joints by joint halves or series of joint halves at a time rather than by individual laminations 12 at a time dramatically expedites reclosing core 10. Moreover, handling the fragile amorphous metal laminations individually often results in their fracture, even if done with great care. While a light weight vanishing oil has been found to be well suited to expedite the core lacing procedure, other fluids, such as for example perchloroethylene, could be utilized to establish the requisite surface tension without leaving harmful residue.

FIG. 5 shows this assembly completed with the transformer coils 28 enclosed in core window 20 and locking turn 24 resecured in embracing relation about core legs 21. It is important to note that edge bonding layer 26 ensures that laminations 12 are not disoriented as the core is reclosed, and thus the core in its completed assembly with the transformer winding coil assumes the exact same configuration it possessed at the time it was annealed. Thus virtually allof the stress induced in the laminations during the core lacing procedure are effectively relieved. Another function of the bonding layer 26 is that it acts as a shell to confine to the core any chips or particles that might possibly be detached from the upper yoke or the encased leg regions during construction or use of the core. In this connection, a second application of the bonding agent may be made to lower yoke 23 of the completed core and coil assembly to provide an all-encompassing bonding layer protective shell. Although it is desirable that the bonding layer continuously cover the illustrated bonded area of the core, in some cases sufficient restraint against relative movements of the laminations is obtained if the bonding layer is discontinuous in this area, e.g., applied in stripes.

FIG. 5 shows a longer, preformed foundation partial turn **22*b* being substituted for the shorter one 22*a* of FIG. 2 so as to be lapped with foundation partial turn 18. Thus, these partial turns may be securely bonded together during final assembly. This will significantly improve the core's short circuit strength. The same bonding agent constituting layer 26 may be utilized for this purpose. If short circuit strength is not a consideration, foundation partial turn 22*a* may be reinstalled in the core window after the coils 28** are in place, and then the core is reclosed.

From the foregoing description, it is seen that there is provided an improved, low loss transformer core whose amorphous ferromagnetic laminations are well protected against chipping and fracture during the core farication process, the core lacing procedure, subsequent handling and shipping, and while in service. As also seen, the invention provides an improved method for manufacturing a transformer core and winding assembly wherein the low core loss characteristics afforded by amorphous metal are not jeopardized by virtue of residual stresses therein or damage to the core laminations. It will be appreciated that the present invention is equally applicable to both shell type and core type transformer configurations. Moreover, the invention is applicable to amorphous metal cores wound directly into a rectangular configuration, rather than being wound into an annular form and then shaped rectangular, as disclosed herein.

With respect to shell-type transformer configurations, FIG. 6 shows one way in which the invention can be applied thereto. The transformer of FIG. 6 comprises two cores 50 and a single coil structure 28. Each core 50 is made in essentially the same way as the core 10 of FIG. 2 except that (a) the joints 16 of each core are located in a core leg 21 rather than in a yoke 19 and (b) the bonding agent 26 is applied to only one leg and one yoke of the cores 50. The jointed leg has an upper portion **21*a* on one side of the joints 16 and a lower portion 21*b* on the other side of the joints 16. Each core 50 is laced into the coil structure 28 by first opening the joints 16 and displacing the unbonded portions of the amorphous metal laminations of the core into the dotted line positions 54 and 56. Position 54 is attained by moving the upper portions 21*a* of the jointed leg into alignment with the upper yoke 19 and by moving the upper yoke into alignment with the other leg 21. Preferably a splint (not shown) is placed around the aligned portions 21*a*, 19, and the upper portion of the bonded leg 21 to hold them in approximate alignment in the position 54. This aligned core structure at 54 and the core structure at 56 are then dipped into the oil bath in generally the manner shown in FIG. 4. Thereafter, referring to the right hand core 50, the aligned core structure at 54 is threaded through the bore of coil structure 28, positioning the core structures in the core window as shown by the dot-dash lines 60 in the window of the right hand core 50. Thereafter, the unbonded core portions at 54 and 56 are wrapped around the coil structure 28 and returned to their closed-joint position shown in solid lines in FIG. 6. The unbonded core portions are typically returned to their closed-joint positions one joint half or one series of joint halves at a time, beginning with the radially intermost joint and progressing with succeeding joints in a radially outward direction. The same steps are repeated for the left hand core 50 in order to lace this core into the coil structure. The right hand leg 21 of the left hand core fits into the bore of the coil structure 28** in the space that is left unoccupied by the left hand leg of the right hand core.

Although we have describe hereinabove a method in which the core is laced into the coil structure as a single unit, our invention in its broadest aspects can be applied to a method in which the core is formed from a plurality of units individually laced into the coil structure. FIG. 7 illustrates such an embodiment.

In this embodiment the core comprises two units 44 and 46, which will be referred to respectively as an inner core and an outer core. The inner core 44 is first laced into the coil structure 28 in essentially the same manner described hereinabove with respect to core 10 of FIGS. 2 and 3. The joints 16 of the inner core are located in its lower yoke. Thereafter, the outer yoke is laced into the coil structure 28 in essentially the same manner, but with the joint 16 located in the upper yoke instead of the lower yoke. The outer core is introduced into the coil structure from the opposite end as that used for introducing the inner coil structure.

Although the illustrated cores have a rectangular cross section, it is to be understood that the invention is applicable to cores with other cross sections, e.g., round, oval or cruciform. Typically, the coil structure 28 that surrounds a leg of the core will have a bore of generally the same cross-sectional shape as the leg. Moreover, while the amorphous metal cores have been disclosed herein as having step lap joints, it will be appreciated that our invention is applicable to amorphous metal cores having other types of joints, such as staggered butt joints for example.

It is thus seen that the objects of the present invention set forth above, including those made apparent from the preceding description, are efficiently attained and, since certain changes may be made in the above construction and method of achieving same without departing from the scope of the invention, it is intended that all matter contained in the above description or shown in the accompanying drawings shall be interpreted as illustrative and not in a limiting sense.

Having described the invention, what is claimed as new and desired to secure by Letters Patent is:

1. In an electric transformer,

A. a preformed coil structure;

B. a wound core of closed-loop configuration extending about a window and having joints in a localized region thereof that allow said core to be opened at said joints to permit insertion into said window of said preformed coil structure, wheresupon said coil structure surrounds a portion of said core, said core comprising superposed laminations of thin amorphous ferromagnetic strip material which extend continuously around said core from said localized joint region;

C. said amorphous ferromagnetic laminations including predetermined portions adjacent said joints which are displaced a relatively large distance from said localized joint region to provide a wide opening into said core window for said insertion of said preformed coil structure; and D. A coating of an adhesive bonding agent applied before said displacement to the exposed lateral edges of said laminations in regions of said core not including said predetermined portions, thereby holding said laminations in correct assembled relationship when said core is opened, yet with interfering with displacement of said predetermined portions while said predetermined portions are being moved to open or reclose said joints, E. said predetermined portions of said core adjacent said joints being substantially free of said adhesive bonding agent during said displacement icnident to opening and reclosing said joints, thereby allowing relative movement of the laminations in each of said predetermined core portions during said displacement.

2. The transformer structure of claim 1 in combination with:

(a) at least one foundation layer of strip substantially thicker than said laminations situated in said core window to provide underlying support and protection for said laminations; and (b) an outer locking turn secured in embracing relation about said laminations to provide overlying support and protection therefor.

3. The transformer defined in claim 2, wherein said core is wound in an annular form and subsequently shaped into a generally rectangular configuration.

4. The transformer defined in claim 3, wherein a portion of said foundation layer is present during shaping of said core into its generally rectangular configuration and is formed during such shaping with rounded corners of a sufficient radius to prevent fracture of said laminations conformed thereabout.

5. The transformer structure defined in claim 4, wherein said foundation layer includes first and second metallic, U-shaped strips of a thickness substantially greater than said laminations, said first strip disposed in said core window with its open side facing said joint region, and second strip disposed in said core window in inverted relation to said first strip.

6. The transformer structure defined in claim 5, wherein said coating edge bonds said first strip to said laminations.

7. The transformer structure defined in claim 2, wherein said coating edge bonds said locking turn to said laminations.

8. The transformer structure defined in claim 5, wherein said first and second strips are bonded together after said coil structure is disposed in said core window.

9. The transformer structure defined in claim 1, wherein said joints between said laminations are arranged as distributed gap joints.

10. The transformer structure defined in claim 9, wherein each said joint includes a plurality of said laminations.

11. The transformer structure defined in claim 10, wherein a foundation layer of strip substantially thicker than said laminations is situated in said core window to provide underlying support and protection for said laminations during shaping of said core, said foundation layer being formed during said shaping with rounded corners of a sufficient radius to prevent fracture of said laminations conformed thereabout.

12. The transformer structure defined in claim 11, wherein said foundation layer includes first and second metallic, U-shaped strips of a thickness substantially greater than said laminations, said first strip disposed in said core window with its open side facing said joint region, and second strip disposed in said core window in inverted relation to said first strip.

13. The combination of claim 1 in which:

(a) said core is of a generally rectangular configuration and comprises two spaced-apart yokes and two spaced-apart legs joining said yokes, each yoke being joined to said legs at corner regions of said core;

(b) said localized joint region is located in one of said yokes, and said predetermined portions are located in said one yoke and extend on opposite sides of said joints between said joint region and two of said corner regions;

(c) said predetermined portions are displaceable into positions approximately aligned when said legs with said core is opened for insertion of said coil structure, thereby causing flexing of said two corner regions; and (d) during said displacement and remaking of said joints, said bonding coating is located on the edges of said laminations in regions of said core that do not include said two corner regions.

* * * * *

UNITED STATES PATENT AND TRADEMARK OFFICE

CERTIFICATE OF CORRECTION

PATENT NO. : 4,789,849

DATED : December 6, 1988

INVENTOR(S) : D. E. Ballard and W. Klappert

It is certified that error appears in the above—identified patent and that said Letters Patent is hereby corrected as shown below:

In claim 1, line 7, "wheresupon" should read - whereupon -

In claim 1, line 24, "with" should read - without -

In claim 1, line 30, "icnident" should read - incident -

Signed and Sealed this

Fifth Day of September, 1989

*Attest:*

*Attesting Officer*

DONALD J. QUIGG

*Commissioner of Patents and Trademarks*